US009822480B2

(12) United States Patent
Fung et al.

(10) Patent No.: US 9,822,480 B2
(45) Date of Patent: Nov. 21, 2017

(54) GARMENT TREATMENT SYSTEM

(71) Applicant: Conair Corporation, Stamford, CT (US)

(72) Inventors: Kam Fai Fung, Hong Kong (CN); Kin Man Lai, Hong Kong (CN)

(73) Assignee: CONAIR CORPORATION, Stamford, CT (US)

( * ) Notice: Subject to any disclaimer, the term of this patent is extended or adjusted under 35 U.S.C. 154(b) by 183 days.

(21) Appl. No.: 14/643,599

(22) Filed: Mar. 10, 2015

(65) Prior Publication Data

US 2015/0252518 A1 Sep. 10, 2015

(51) Int. Cl.
*D06F 73/00* (2006.01)
*D06F 87/00* (2006.01)

(52) U.S. Cl.
CPC ..... *D06F 73/00* (2013.01); *D06F 87/00* (2013.01)

(58) Field of Classification Search
CPC ..... D06F 73/00; D06F 75/12; D06F 75/30; D06F 87/00
See application file for complete search history.

(56) References Cited

U.S. PATENT DOCUMENTS 3,559,427 A 2/1971 Baker
3,581,529 A 6/1971 Mitchell et al.
3,603,490 A * 9/1971 Killey ..... D06F 73/00 223/70
3,646,317 A 2/1972 Osrow
3,675,449 A 7/1972 Bluestein
3,726,450 A * 4/1973 Richterkessing ..... D06F 73/00 223/70
4,426,857 A 1/1984 Epstein
4,485,519 A 12/1984 Collier
4,810,854 A 3/1989 Jursich et al.
4,817,309 A * 4/1989 Frank ..... D06F 75/30 38/15
4,875,249 A 10/1989 Collier
D319,121 S 8/1991 Muller
5,123,266 A 6/1992 Tabraham
5,224,237 A 7/1993 Ambrosiano
5,609,047 A 3/1997 Hellman, Jr. et al.
5,611,868 A 3/1997 Gurstein et al.
(Continued)

FOREIGN PATENT DOCUMENTS

EP 079866 A1 5/1983
EP 290269 A2 11/1988
(Continued)

*Primary Examiner* — Jason Ko
*Assistant Examiner* — Spencer Bell
(74) *Attorney, Agent, or Firm* — Lawrence Cruz, Esq.; Joseph W Schmidt, Esq.

(57) ABSTRACT

A garment treatment system includes a base, a water tank mounted to the base and having water contained therein, a steam generator in fluid communication with the water tank and adapted to convert the water from the water tank into steam, a steam nozzle having a steam reservoir and a steam outlet for distributing the steam to a garment, a first lumen in fluid communication with the steam generator and the steam nozzle for delivering steam to the steam reservoir of the steam nozzle and a second lumen in fluid communication with the steam reservoir of the steam nozzle and the water tank for returning condensed water to the water tank.

18 Claims, 16 Drawing Sheets

(56) References Cited

U.S. PATENT DOCUMENTS

| | | | | |
|---|---|---|---|---|
| D421,165 | S | 2/2000 | Joiner et al. | |
| 6,031,969 | A | 2/2000 | Burr et al. | |
| D423,156 | S | 4/2000 | Joiner et al. | |
| 6,061,935 | A | 5/2000 | Lee | |
| D426,924 | S | 6/2000 | Joiner et al. | |
| 6,886,373 | B2 | 5/2005 | Carrubba et al. | |
| 8,407,920 | B2 | 4/2013 | Draghiceanu | |
| 8,510,909 | B2 | 8/2013 | Spatz et al. | |
| 2002/0154011 | A1 | 10/2002 | Pasin et al. | |
| 2004/0010950 | A1 | 1/2004 | Leung et al. | |
| 2004/0050118 | A1 | 3/2004 | Carrubba et al. | |
| 2004/0133295 | A1 | 7/2004 | Cohen et al. | |
| 2004/0144140 | A1 | 7/2004 | Lee | |
| 2005/0150261 | A1 | 7/2005 | Carlucci | |
| 2006/0188239 | A1 | 8/2006 | Carlucci | |
| 2008/0209774 | A1 | 9/2008 | Robin | |
| 2009/0235697 | A1* | 9/2009 | Reid | B08B 3/12 68/3 SS |
| 2009/0255302 | A1 | 10/2009 | Haan | |
| 2010/0166396 | A1 | 7/2010 | Xu et al. | |
| 2014/0339332 | A1* | 11/2014 | Bartelick | A21B 3/006 239/195 |

FOREIGN PATENT DOCUMENTS

| | | | |
|---|---|---|---|
| EP | 1215330 | A1 | 6/2002 |
| EP | 2426252 | A1 | 3/2012 |

* cited by examiner

GARMENT TREATMENT SYSTEM

BACKGROUND

1. Technical Field

The present disclosure relates to a garment treatment system. More particularly, the present disclosure relates to a garment steamer including a steam nozzle with a built in straightener feature and steam adjuster, a condensed water circulation mechanism and an automatic hose reel mechanism.

2. Description of Related Art

Steam generating devices for applying steam are particularly useful in removing wrinkles and improving the appearance of hanging garments, draperies, upholstery, and other items made of fabric. A garment steamer that has a boiler in a reservoir of water, a hand-held wand, and flexible tubing providing a pathway for steam generated by the boiler from the reservoir to a hand-held wand is known. Such appliances have been used to steam the wrinkles out of garments, cloth, fabric, and the like. Such prior art garment steamers typically have an immersion-type resistance heater in the reservoir of water. The heater is energized to boil the water to produce steam. The steam is guided to the hand-held wand via the flexible tubing. One example of a garment steamer is disclosed in U.S. Patent Publication No. 20050150261A1 to Carlucci/Conair Corp, the entire contents of which are incorporated herein by reference.

SUMMARY

Accordingly the present disclosure is directed to a garment treatment system, including a base, a water tank mounted to the base and having water contained therein, a steam generator in fluid communication with the water tank and adapted to convert the water from the water tank into steam, a steam nozzle having a steam reservoir and a steam outlet for distributing the steam to a garment, a first lumen in fluid communication with the steam generator and the steam nozzle for delivering steam to the steam reservoir of the steam nozzle and a second lumen in fluid communication with the steam reservoir of the steam nozzle and the water tank for returning condensed water to the water tank.

A hose reel may be mounted to the base and has a hose wound about the hose reel. The hose reel is adapted for rotational movement within the base in a first direction to wind the hose about the hose reel and in a second direction to permit removal of the hose from the hose reel. The hose defines the first and second lumens.

The hose reel may include a releasable lock mechanism for releasably securing the hose at predefined lengths during removal of the hose from the hose reel. The releasable lock mechanism includes ratchet teeth associated with the hose reel and a pawl. The ratchet teeth are arranged to be selectively engaged by the pawl during movement of the hose reel in a second direction to prevent movement of the hose reel in the first direction. A spring may normally bias the hose reel toward the first rotational direction. The ratchet teeth may define a relief area in which the pawl enters upon rotation of the hose reel in the second direction through a predetermined angular sector of rotation whereby the pawl releases the ratchet teeth and permits the hose reel to rotate in the first rotational direction under the bias of the spring to automatically wind the hose about the hose reel.

The steam nozzle includes an upper and a lower housing component separated by a garment receiving gap. The garment receiving gap is dimensioned to receive a portion of a garment whereby steam released from the steam outlet contacts the garment portion of the garment to provide a straightening effect on the garment portion. The lower housing component includes a sole plate. The sole plate includes at least one steam channel, which permits passage of steam. A pair of steam channels may extend through the sole plate. In the alternative, the steam nozzle includes a plurality of steam outlets and a plurality of steam channels in the soleplate.

The steam nozzle may include a steam adjustor to control the volume of steam emitted by the steam outlet. The steam adjustor includes a steam adjustor knob and an adjustor plate connected to the adjustor knob. The adjustor plate defines an elongated steam adjustor gap having a varied cross-sectional dimension. The steam adjustor knob is movable to selectively position the steam adjustor gap relative to the steam outlet to control the volume of flow of steam through the steam adjustor gap and the steam outlet.

A telescopic pole may extend from the base and has a handle. The handle may include a retractable hanger. The retractable hanger includes a first hanger segment and a second hanger segment, which are adapted to move in opposing directions within the handle between a stored and an extended condition. The handle may include a nozzle holder segment for supporting the steam nozzle.

The base may include a refresh compartment for receiving a garment. The refresh compartment is fluidly couplable with the steam generator such that steam enters the refresh compartment to treat the garment. A valve mechanism may be provided for selectively directing steam emitted by the steam generator to the steam nozzle or the refresh compartment. An ion generator may be in communication with the refresh compartment.

BRIEF DESCRIPTION OF THE DRAWINGS

Various embodiments of the present disclosure are described hereinbelow with references to the drawings, wherein.

DETAILED DESCRIPTION

Figure 1:
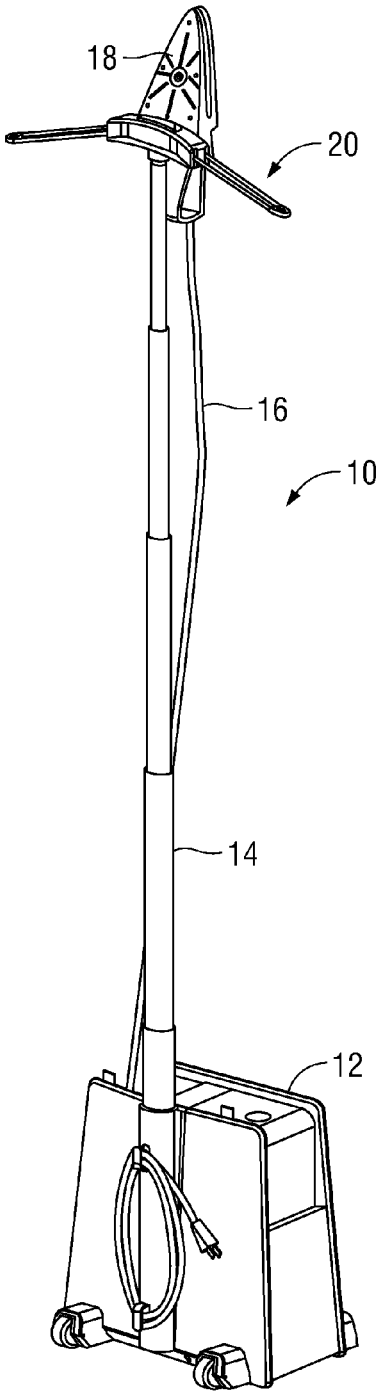
FIGS. 1-2 are perspective views of the garment treatment system in accordance with the principles of the present disclosure.
Figure 2:
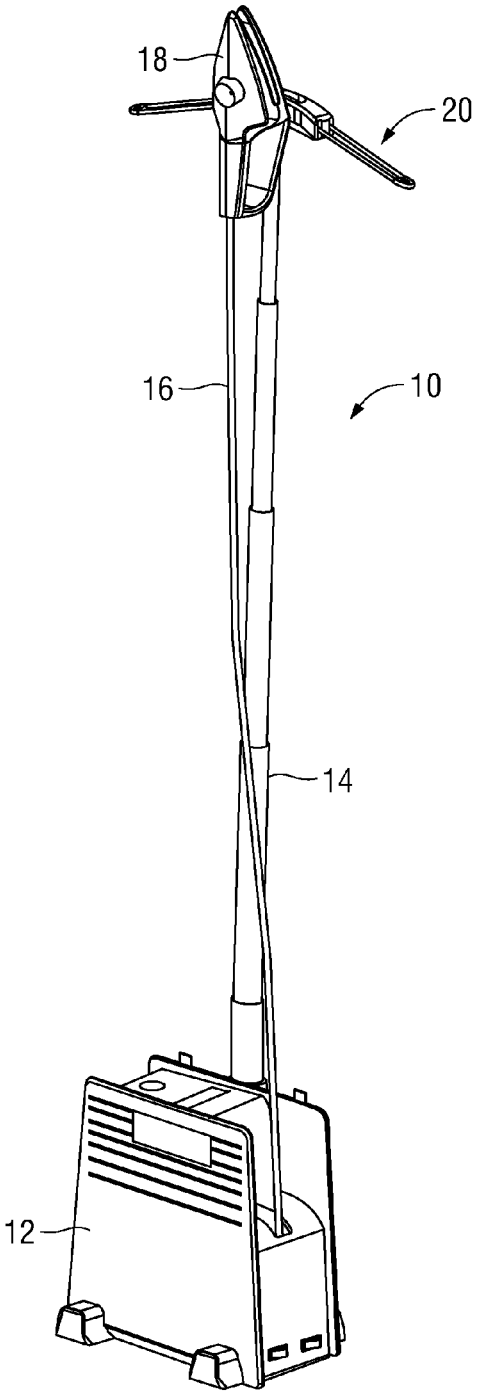
Figure 3:
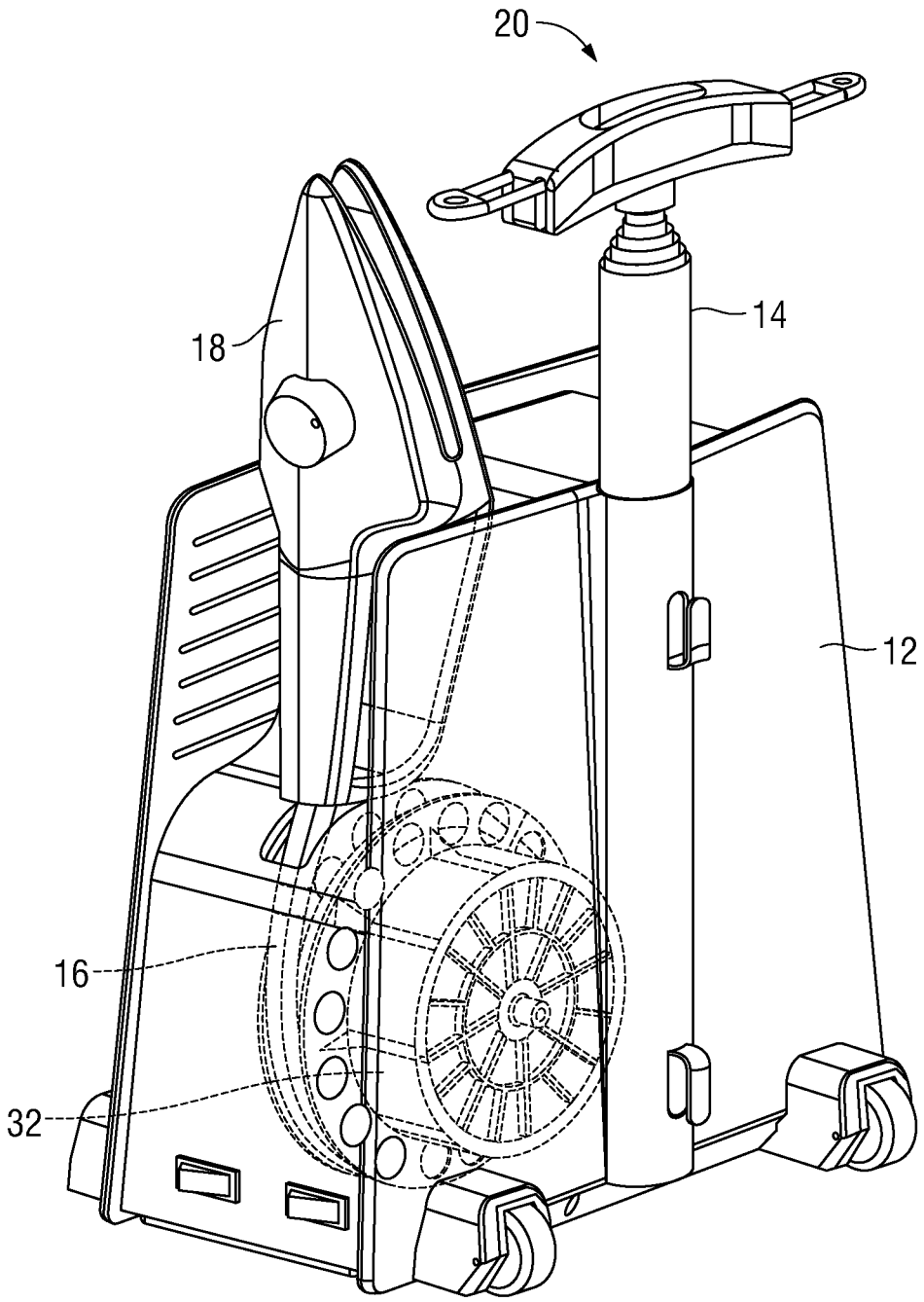
FIG. 3 is a perspective view of the garment treatment system in a stored condition.

Referring now to the drawing figures wherein like reference numerals identify similar or like components throughout the several views, FIGS. 1-2 illustrate the garment treatment system 10 in accordance with the principles of the present disclosure. The garment treatment system 10 includes a base 12, a telescopic pole 14 extending from the base 12, a dual lumen hose 16 connected to the base 12 and a steam nozzle 18 coupled to the dual lumen hose 16. The telescopic pole 14 has a retractable handle 20 connected to its free end. FIG. 3 illustrates the garment treatment system 10 in a stored condition with the telescopic pole 14 retracted, and the steam nozzle 18 stored relative to the base 12.

Figure 4:
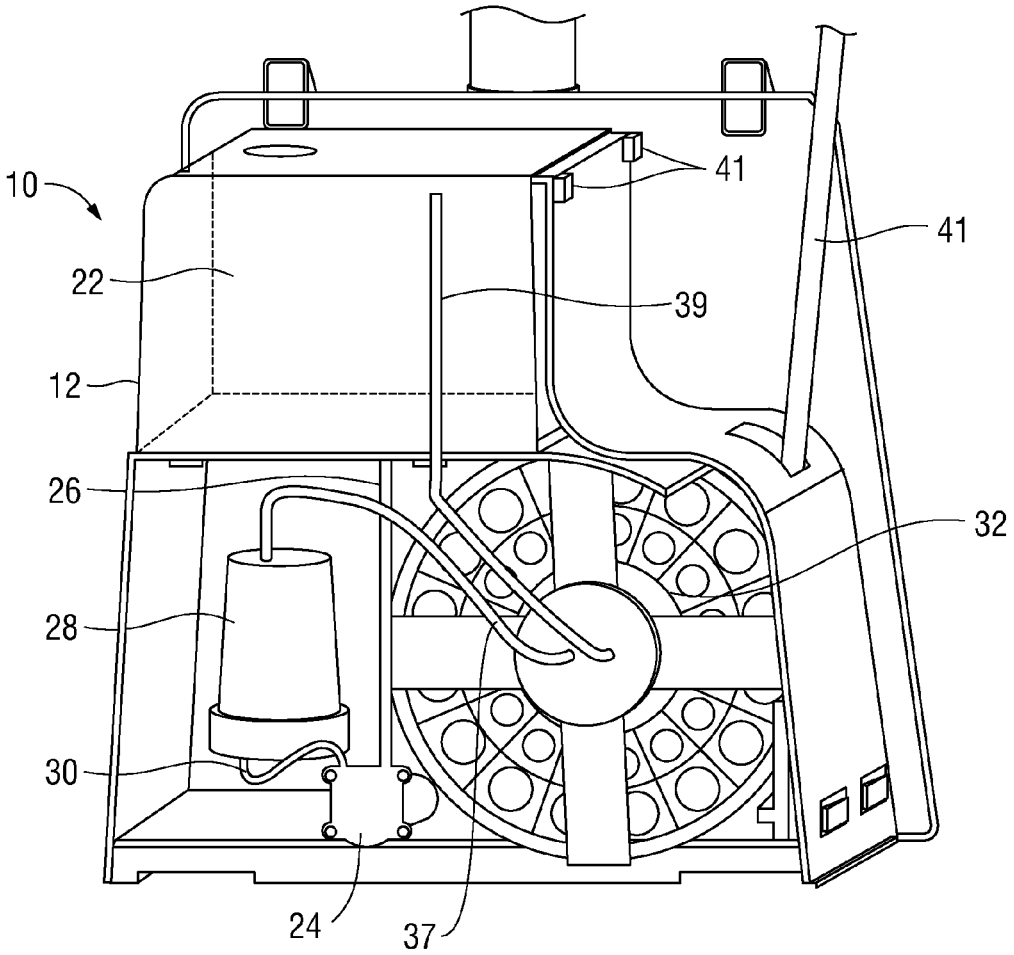
FIG. 4 is a perspective view with portions removed of the base of the garment treatment system illustrating the water tank, steam generator, pump and hose reel.

Referring now to FIGS. 3-4, components of the base 12 will be discussed. The base 12 includes a fluid or water tank 22, a pump 24 connected to the water tank 22 through tubing 26 and a steam generator 28 which is coupled to the pump 24 through tubing 30. The steam generator 28 may include any suitable heating, boiler or coil arrangement to convert a fluid, e.g., water, delivered from the water tank 22 to steam. The pump 24 may be any suitable pump to deliver water to the steam generator 28 such as a peristaltic pump, and axial pump, a centrifugal pump or the like. In one embodiment, the pump 24 is a peristaltic pump.

Figure 5:
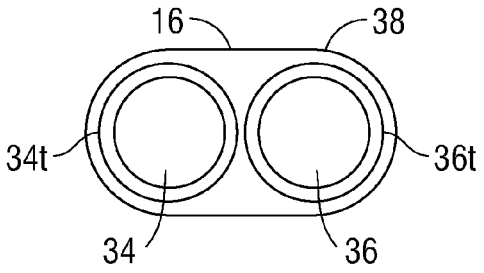
FIG. 5 is a cross sectional view of the dual lumen hose.

The base 12 further includes an automatic hose reel mechanism 32 about which the dual lumen hose 16 is wrapped and stored. As best depicted in FIG. 5, the dual lumen hose 16 includes a first lumen 34 for delivering steam from the steam generator 28 to the steam nozzle 18 and a second lumen 36 for directing condensed water from the steam nozzle 18 back to the water tank 22. The dual lumen hose 16 may include a textile braid cover 38 and first and second plastic tubes 34*t*, 36*t*, which respectively define the first steam and second water lumens 34, 36. The first lumen 34 of the dual lumen hose 16 is in fluid communication with the steam generator 28 through tubing 37 and the second lumen 36 in fluid communication with the water tank 22 through tubing 39. The base 12 further includes a pair of opposed clamps 41 which support the steam dispenser 18.

Figure 6:
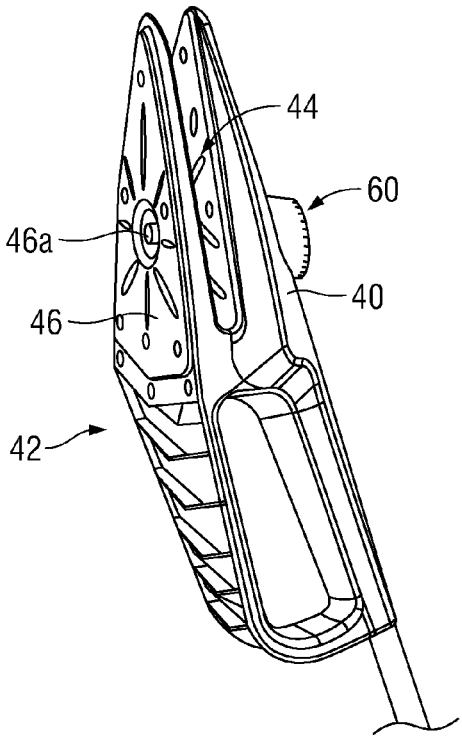
FIGS. 6-7 are perspective views of the steam nozzle.
Figure 7:
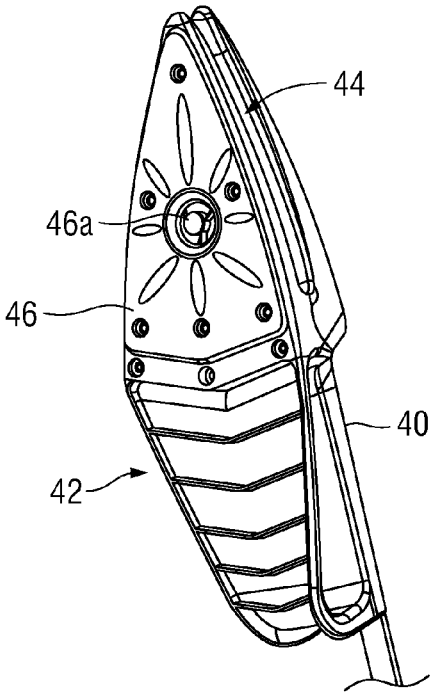
Figure 8:
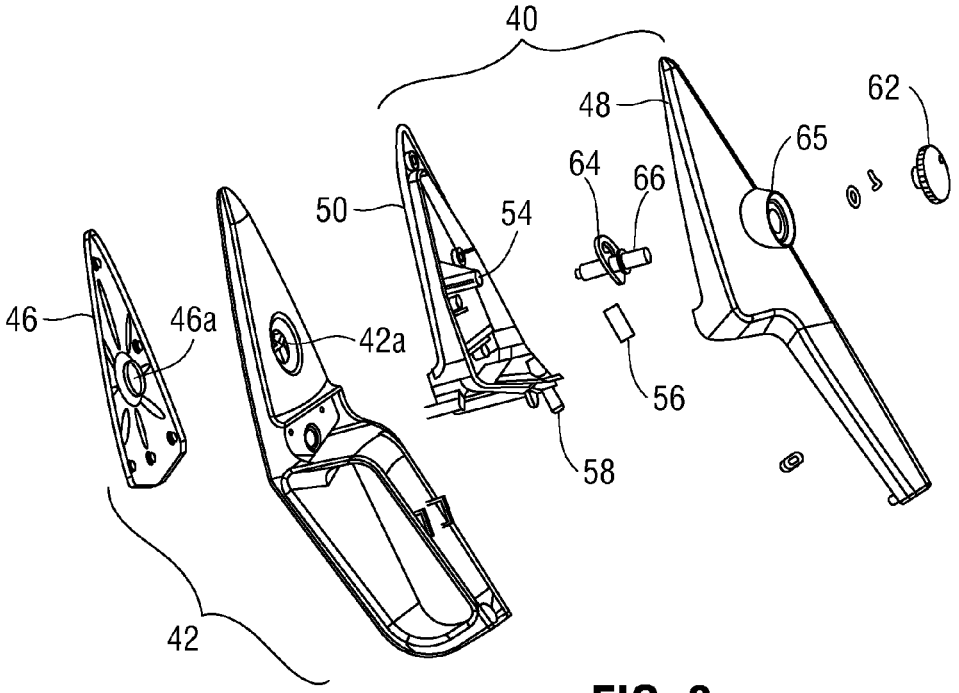
FIG. 8 is an exploded perspective view of the steam nozzle of FIGS. 6-7.
Figure 9:
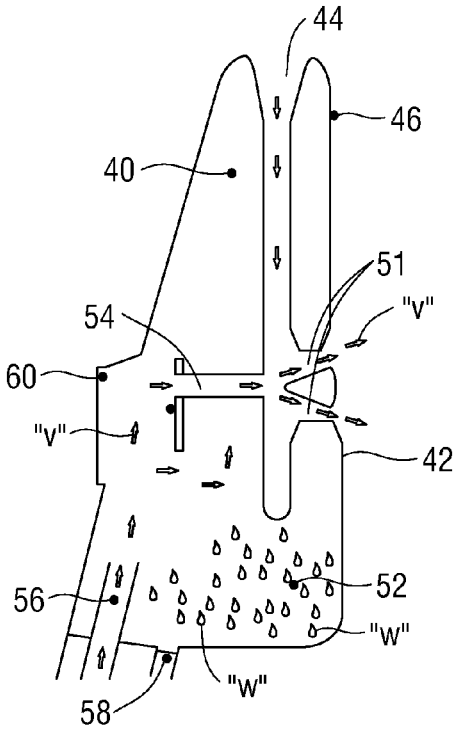
FIG. 9 is a schematic view of the steam nozzle.

Referring now to FIGS. 6-8, and the schematic view of FIG. 9, the steam nozzle 18 will be discussed. The steam nozzle 18 is a dual functioning device having the capability to emit pressurized steam to provide an 1) ironing function and a 2) straightening function. The steam nozzle 18 generally includes an upper housing component 40 and a bottom housing component 42, which are separated by a gap or space, hereinafter referred to as a straightener gap 44. The bottom housing component 42 provides for the ironing function of the steam nozzle 18 and has a metallic soleplate 46 connected thereto.

The upper and bottom housing components 40, 42 cooperate to provide the straightening function on, e.g., a garment positioned within the straightener gap 44. The upper housing component 40 includes first and second upper housing frames 48, 50 connected to each other to define, along with the bottom housing component 42, a reservoir 52 as best depicted in FIG. 9. The reservoir 52 receives the steam "v" generated by the steam generator 28, and directs the steam "v" through a centrally positioned steam outlet 54 in the second housing frame 50 of the upper housing component 40 and apertures 42*a* and 46*a* within the bottom housing component 42 and the soleplate 46, respectively (FIG. 8). One or both of the bottom housing component 42 and the soleplate 46 may include one or more steam passages 51 to permit exit of the steam from the steam outlet 54 to heat the soleplate 46 and direct steam out to the garment. A steam inlet including, e.g., a steam inlet tube 56, is in fluid communication with the reservoir 52 and the steam lumen 34 of the dual lumen hose 16 for receiving steam from the steam generator 28. A condensed water outlet including, e.g. a water outlet tube 58, is in fluid communication with the reservoir 52 and the water lumen 36 of the dual lumen hose 16 for directing condensed water from the reservoir 52 back to the water tank 22.

Figure 10:
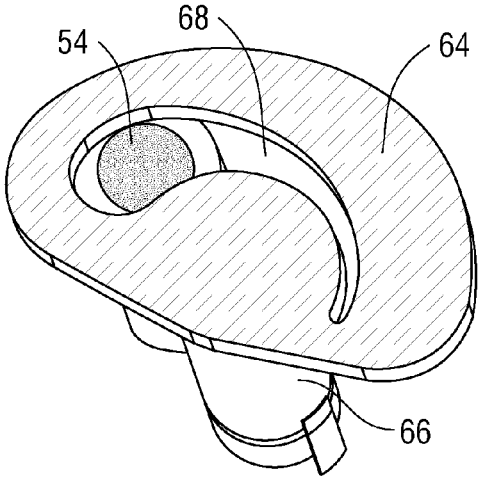
FIG. 10 is a view of the steam adjust mechanism of the steam nozzle.

With reference to FIG. 10, in conjunction with FIGS. 6-9, the steam nozzle 18 further includes a steam adjust mechanism 60 for controlling the volume of steam emitted through the steam outlet 54 of the steam nozzle 18. The steam adjust mechanism 60 including a steam adjust knob 62 and a steam adjustor plate 64 which is connected to the steam adjust knob 62 through a connector 66. The steam adjust knob 62 is mounted for rotational movement within a recess 65 of upper housing component 40 (FIG. 8). The steam adjustor plate 64 defines a tapered, e.g., a crescent shaped outlet opening 68 having a varied cross-sectional dimension. The steam adjustor plate 64 is positionable over the steam outlet 54 to selectively align a segment of the steam adjustor opening 68 over the steam outlet 54. The varying cross-sectional area of the steam adjustor opening 68 permits the user to control the volume of steam passing through the steam outlet 54, and thus the volume of steam emitted by the steam nozzle 18.

Figure 11A:
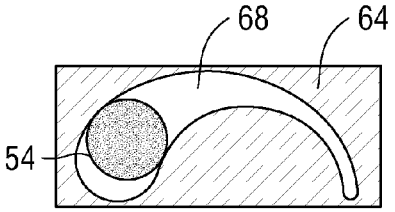
FIGS. 11A-11C are views of representative high, medium and low settings of the steam adjust mechanism of FIG. 10.
Figure 11B:
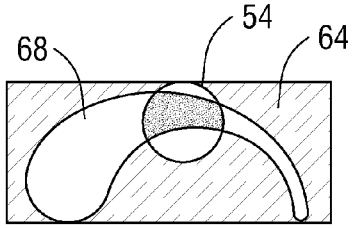
Figure 11C:
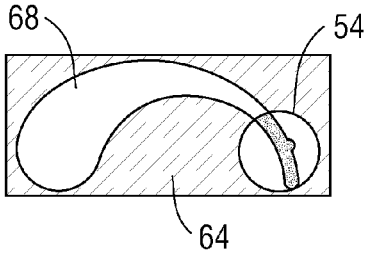

FIGS. 11A-11C illustrate various rotational positions of the steam adjust knob 62 and the steam adjustor plate 64. In FIG. 11A corresponding to a high steam setting, the steam adjustor plate 64 is positioned to align a relatively large cross-sectional segment of the steam adjustor opening 68 over the steam outlet 54 whereby the steam outlet 54 is unobstructed permitting a full volume of steam to pass through the steam outlet 54. In FIG. 11B corresponding to a middle steam setting, the steam adjustor plate 64 is positioned to align a reduced middle segment of the steam adjustor opening 68 over the steam outlet 54 whereby the steam outlet 54 is partially obstructed permitting a reduced volume of steam to pass through the steam outlet 54. In FIG. 11C corresponding to a low steam setting, the steam adjustor plate 64 is positioned to align a further reduced cross-sectional segment of the steam adjustor opening 68 over the steam outlet 54 whereby the steam outlet 54 is further obstructed permitting a further reduced volume of steam to pass through the steam outlet 54. The steam adjustor plate 64 may be selectively manipulated through the steam adjustor knob 62 to assume various additional positions relative to the steam outlet 54 thereby providing precise control over the volume of steam exiting the steam outlet 54.

Figure 13:
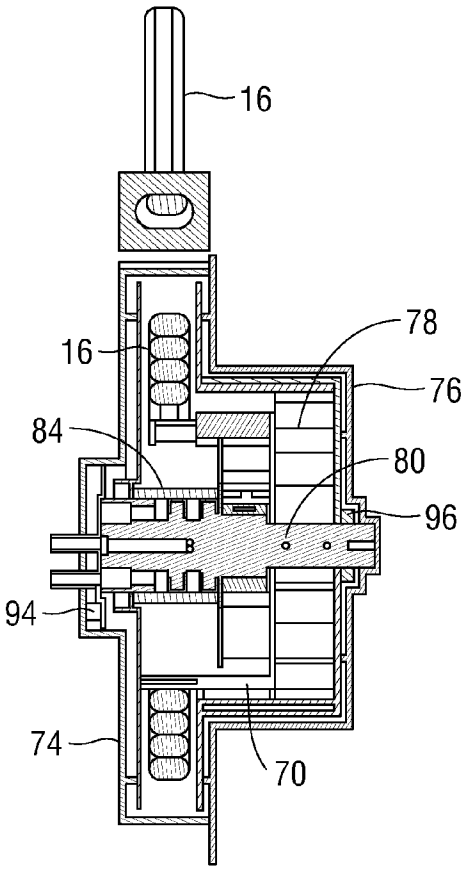
FIG. 13 is a cross-sectional view of the automatic hose reel mechanism taken along the lines 13-13 of FIG. 12.
Figure 12:
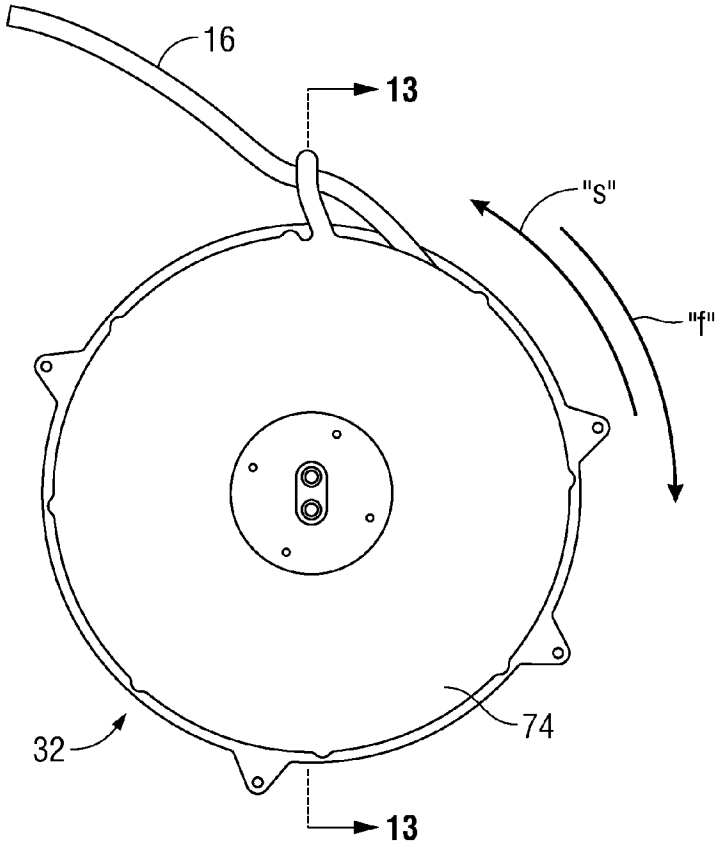
FIG. 12 is a side plan view of the automatic hose reel mechanism of the garment treatment system.
Figure 14:
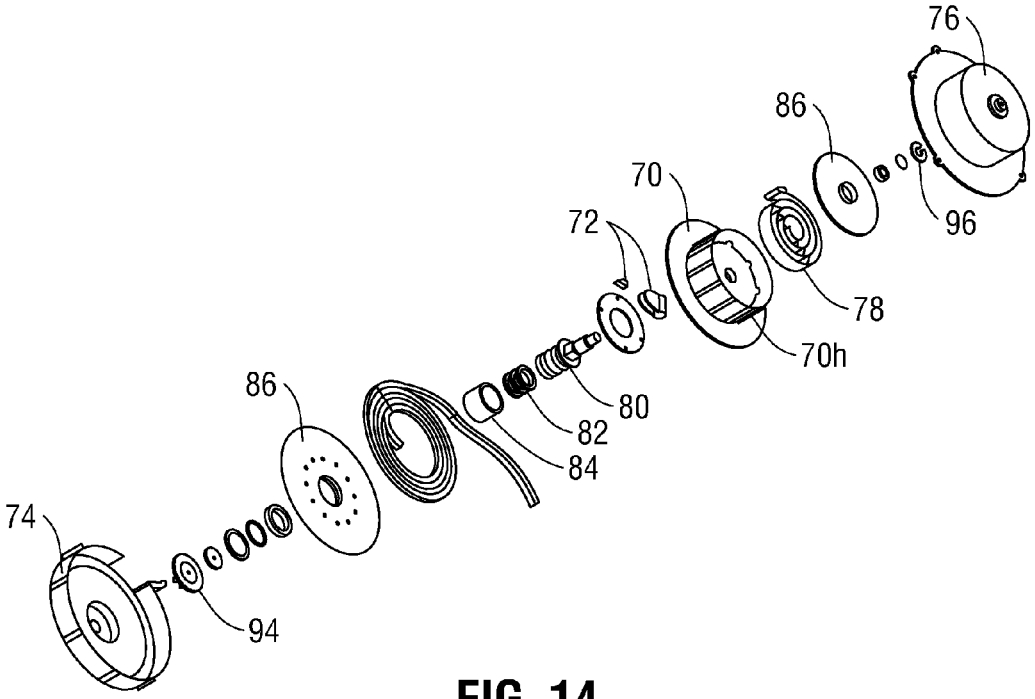
FIG. 14 is an exploded perspective view of the automatic hose reel mechanism.

Referring now to FIGS. 12-14, the automatic hose reel mechanism 32 will be discussed. The automatic hose reel mechanism 32 includes a hose reel 70 about which the dual lumen hose 16 is wound. The hose reel 70 is adapted for rotational movement in first and second rotational directions "f", "s" to permit respective winding and unwinding of the dual lumen hose 16 relative to the hose reel 70. The hose reel mechanism 32 includes a releasable lock mechanism 72 for releasably securing the dual lumen hose 16 at predefined lengths when removed from the hose reel 70. The hose reel mechanism 32 also provides for automatic retraction of the hose reel 70 in the first direction "f" to effect automatic winding of the dual lumen hose 16.

The automatic hose reel mechanism 32 further includes front and back outer hubs 74, 76, which at least partially enclose the hose reel 70, and a spring coil 78 adapted to bias the hose reel 70 in the first rotational direction "f" corresponding to retracting and winding movement of the hose reel 70. The automatic hose reel mechanism 32 further includes a stationary central shaft 80, a seal ring 82 disposed about at least a portion of the central shaft 80 and a rotating ring 84 positioned about the seal ring 82. A pair of plates 86 is also provided to enclose the components within the hose reel mechanism 32. The dual lumen hose 16 is mounted about the backside of the hose reel 70. The hose reel 70 may be secured to the rotating ring 84 which is adapted to rotate about the stationary central shaft 80.

Figure 15:
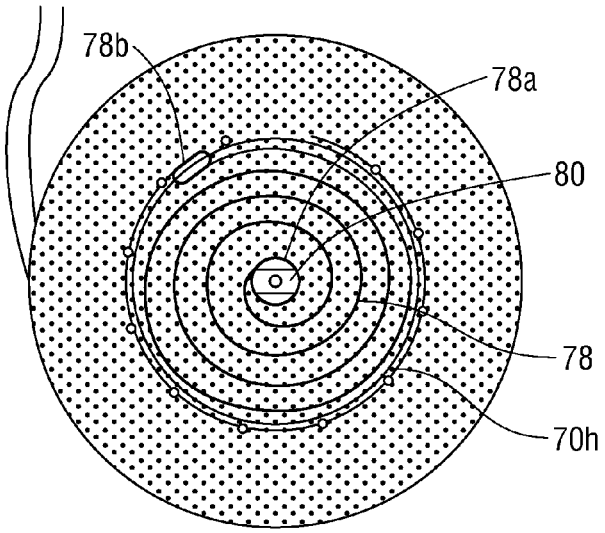
FIG. 15 is a side plan view illustrating the spring coil of the automatic hose reel mechanism.

Referring now to FIG. 15, in conjunction with FIGS. 12-14, the spring coil 78 includes a first end 78*a* secured to the stationary central shaft 80 and a second end 78*b* connected to the hose reel 70. The spring coil 78 normally biases the hose reel 70 toward a normal unstressed condition of the spring coil 78 corresponding to rotational or retracting movement of the hose reel 70 in the first direction "f". The spring coil 78 is accommodated within hub 70*h* of the hose reel 70. (See FIG. 14)

Figure 16C:
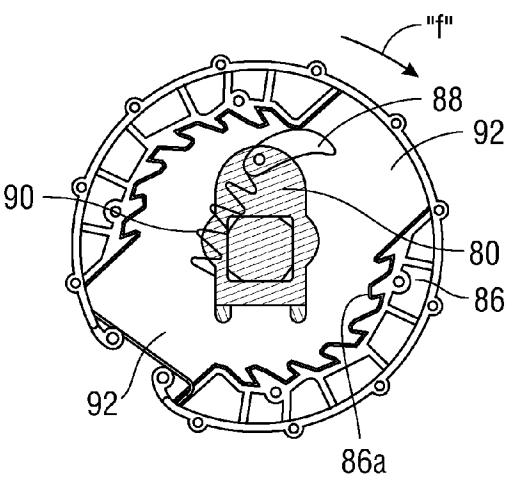
FIGS. 16A-16C are views illustrating operation of the releasable lock mechanism of the automatic hose reel mechanism.
Figure 16B:
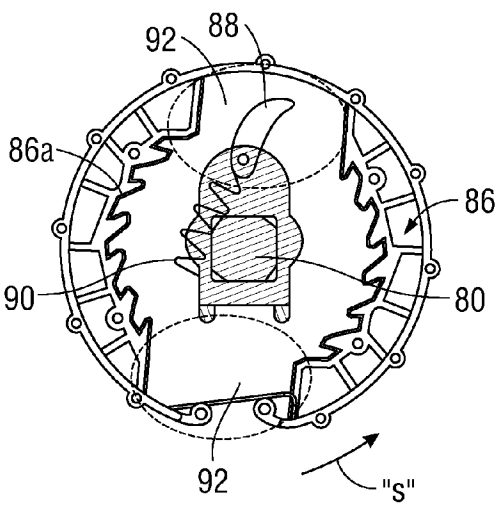
Figure 16A:
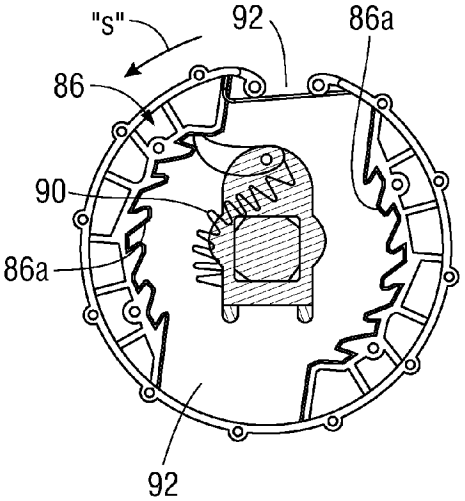
Figure 17:
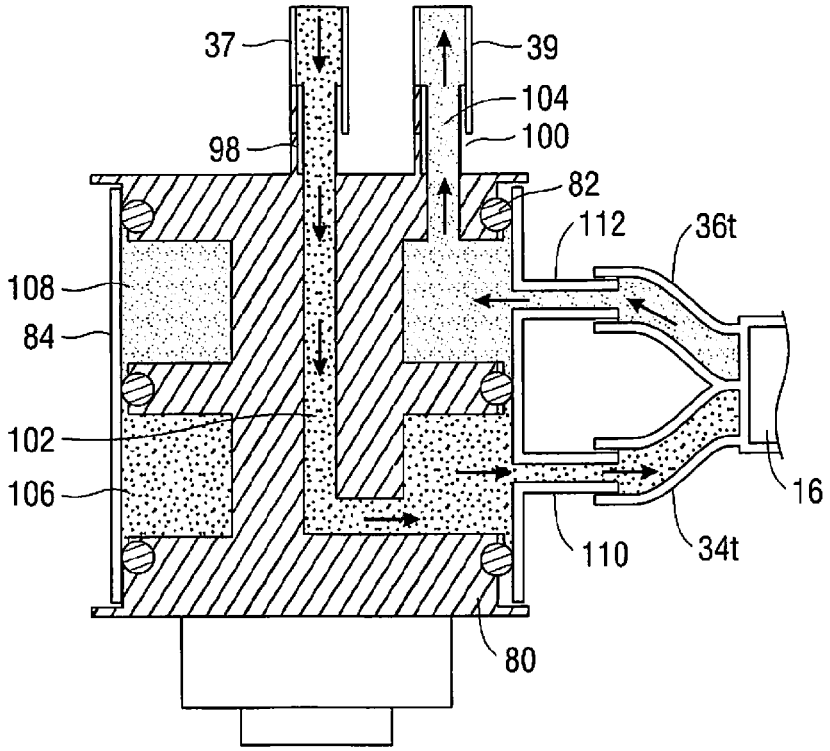
FIG. 17 is a cross-sectional view of the central stationary shaft of the automatic hose reel mechanism.
Figure 18:
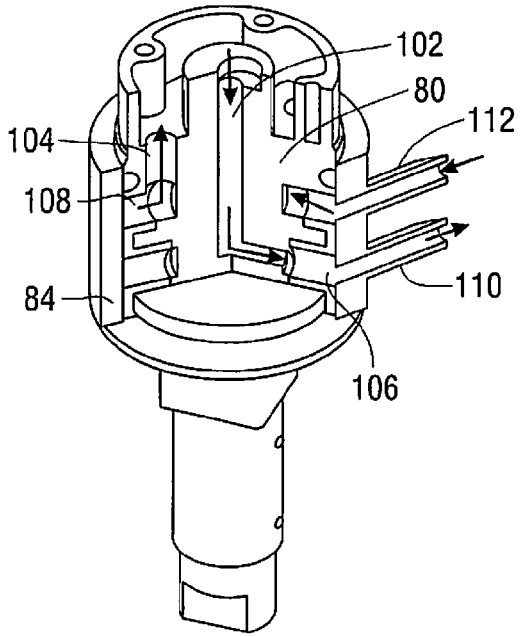
FIG. 18 is a perspective view with portions removed of the central stationary shaft.
Figure 19:
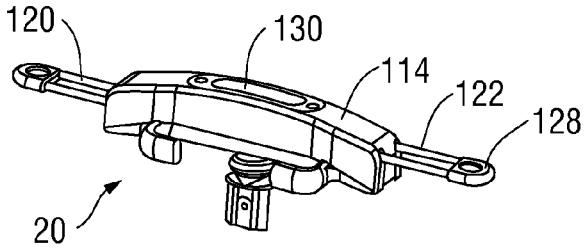
FIGS. 19-20 are perspective views of the handle illustrating the hanger in stored and extended conditions.
Figure 20:
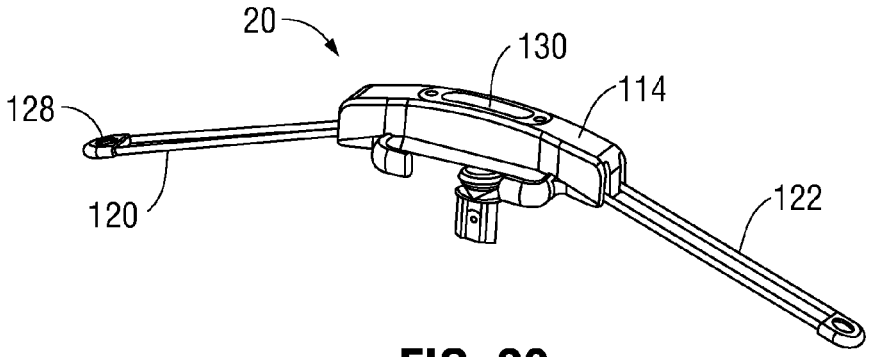
Figure 21:
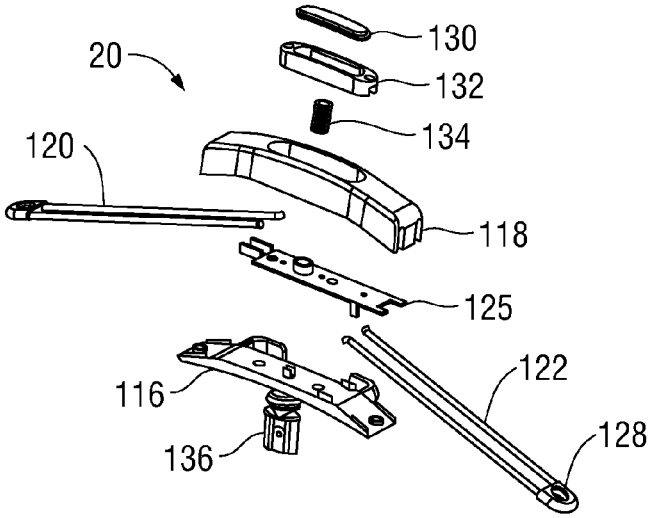
FIG. 21 is an exploded perspective view of the handle.
Figure 22:
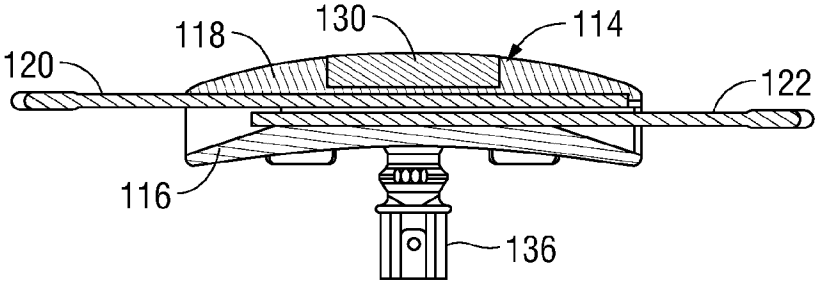
FIGS. 22-23 are cross-sectional views of the handle illustrating the hanger in stored and extended conditions.
Figure 23:
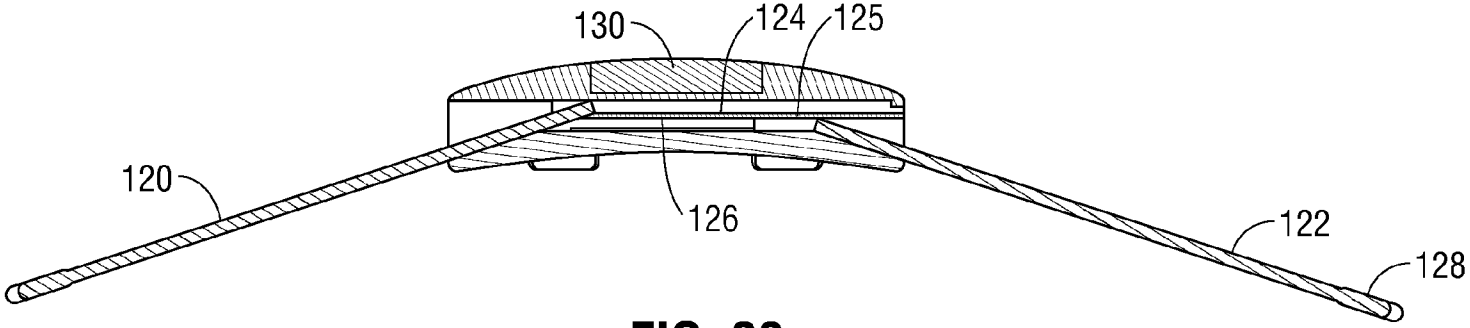

Referring now to FIGS. 16A-16C, in view of FIGS. 12-14, the releasable lock mechanism 72 of the automatic hose reel mechanism 32 includes a ratchet wheel 86 on the rear or backside of the hose reel 70 and having a plurality of ratchet teeth 86*a*. A pawl 88 is pivotally mounted to the central stationary shaft 80 and is adapted to pivot into and out of engagement with the ratchet teeth 86*a*. A spring 90 connected to the stationary shaft 80 and to the pawl 88 normally biases the pawl 88 in a radially outward position depicted in FIG. 16B. The pawl 88 and the ratchet teeth 86*a* are arranged to permit movement of the ratchet wheel 86 and the hose reel 70 in the second unwinding direction "s", while preventing movement of the hose reel 70 in the first wound direction "f". The ratchet wheel 86 includes at least one relief gap, e.g. two diametrically opposed relief gaps 92, which are devoid of ratchet teeth 86*a*.

In use, the dual lumen tube 16 is extended causing the hose reel 70 and the ratchet wheel 86 to rotate in the second unwinding direction "s" depicted in FIGS. 16A-16B. As the ratchet wheel 86 rotates in the second direction "s", the pawl 88 pivots into and out of engagement with the ratchet teeth 86*a*. Upon release of the dual lumen hose 16, the pawl 88 engages the ratchet teeth 86*a* to prevent rotational movement in the first winding direction "f" of the ratchet wheel 86 and the hose reel 70 thereby securing the dual lumen hose 16 at a desired length for use. Further extension of the dual lumen hose 16 from the hose reel 70 causes the hose reel 70 and the ratchet wheel 86 to further rotate such that the pawl 88 enters one of the relief areas 92 of the ratchet wheel 86 where the pawl 88 is free to move to its outward position under the influence of spring 90. Thus, if the dual lumen 16 hose is released, the pawl 88 pivots to the release position depicted in FIG. 16C permitting the ratchet wheel 86 and the hose reel 70 to rotate in the first direction "f" under the influence of coil spring 78 thereby causing the dual lumen hose 16 to be automatically wound about the hose reel 70.

Referring now to FIGS. 13, 14, 17 and 18, the central stationary shaft 80 of the automatic hose reel mechanism 32 will be discussed. The central shaft 80 is fixed at each end to front and back hubs 74, 76 through clamps or locks 94, 96 or any other conventional means. The central stationary shaft 80 includes a steam fluid port 98 and a water port 100 which are connected to connector tubes 37, 39 respectively (FIG. 4) extending from the steam generator 28 and the water tank 22. The central stationary shaft 80 includes a central lumen 102 in fluid communication with the steam fluid port 98 and a side or offset lumen 104 in communication with the water port 100. The central stationary shaft 80 further includes a steam circumferential lumen 106 in fluid communication with the central lumen 102 and a water circumferential lumen 108 in fluid communication with the side lumen 104. The steam circumferential lumen 106 and water circumferential lumen 108 are in respective fluid communication with a steam outlet port 110 and a water outlet port 112 of the rotating ring 84. The steam outlet port 110 and the water outlet port 112 are fluidly coupled to the steam tube 34*t* (steam lumen 34) and the water tube 36*t* (water lumen 36) of the dual lumen hose 16. The steam outlet port 110 and the water outlet port 112 are components of the rotating ring 84 and thus rotate with the rotating ring 84 upon rotation of the hose reel 70. Thus, the steam outlet port 110 and the water outlet port 112 are constantly in fluid communication with the steam and water circumferential lumens 106, 108. The one or more seals 82 maintain a seal of the rotating ring 84 and the central stationary shaft 80 during rotation of the rotating ring 84.

Referring now to FIGS. 19-23, the retractable handle 20 connected to the telescopic pole 14 will be discussed. The handle 20 includes a frame 114 consisting of lower and upper frame segments 116, 118 dimensioned to be grasped by the user and left and right hanger segments 120, 122 slidably mounted between stored (FIGS. 19 and 22) and extended conditions (FIGS. 20 and 23) within the frame 114. In one embodiment, the frame 114 includes upper and lower rails or grooves 124, 126 defined between central plate 125 and the lower and upper frame segments 116, 118 for accommodating respective left and right hanger segments 120, 122. One or both of the hanger segments 120, 122 may have a loop 128 for receiving the hook end of a conventional hanger. In the extended or operable condition of the left and right hanger segments 120, 122, the left and right hanger segments 120, 122 are at least partially displaced from the upper and lower rails 124, 126 to tilt downwardly thereby assuming a sloped arrangement of the hanger segments 120, 122 similar to a conventional hanger.

The handle 20 may further include a release button 130 for releasing the telescopic pole 14 to permit the pole 14 to retract to a stored condition. The release button 130 is disposed within a cover 132 mounted to the frame 114 of the handle 20. A spring 134 biases the release button 130 to a normal upward condition. A connector 136 extends from the lower frame segment and couples with the telescopic pole 14. The release button 130 may incorporate any conventional means for releasing the segments of the telescopic pole 14 upon depression of the button including, e.g., ball bearing arrangements, friction arrangements, cam lock arrangements or the like.

Figure 24:
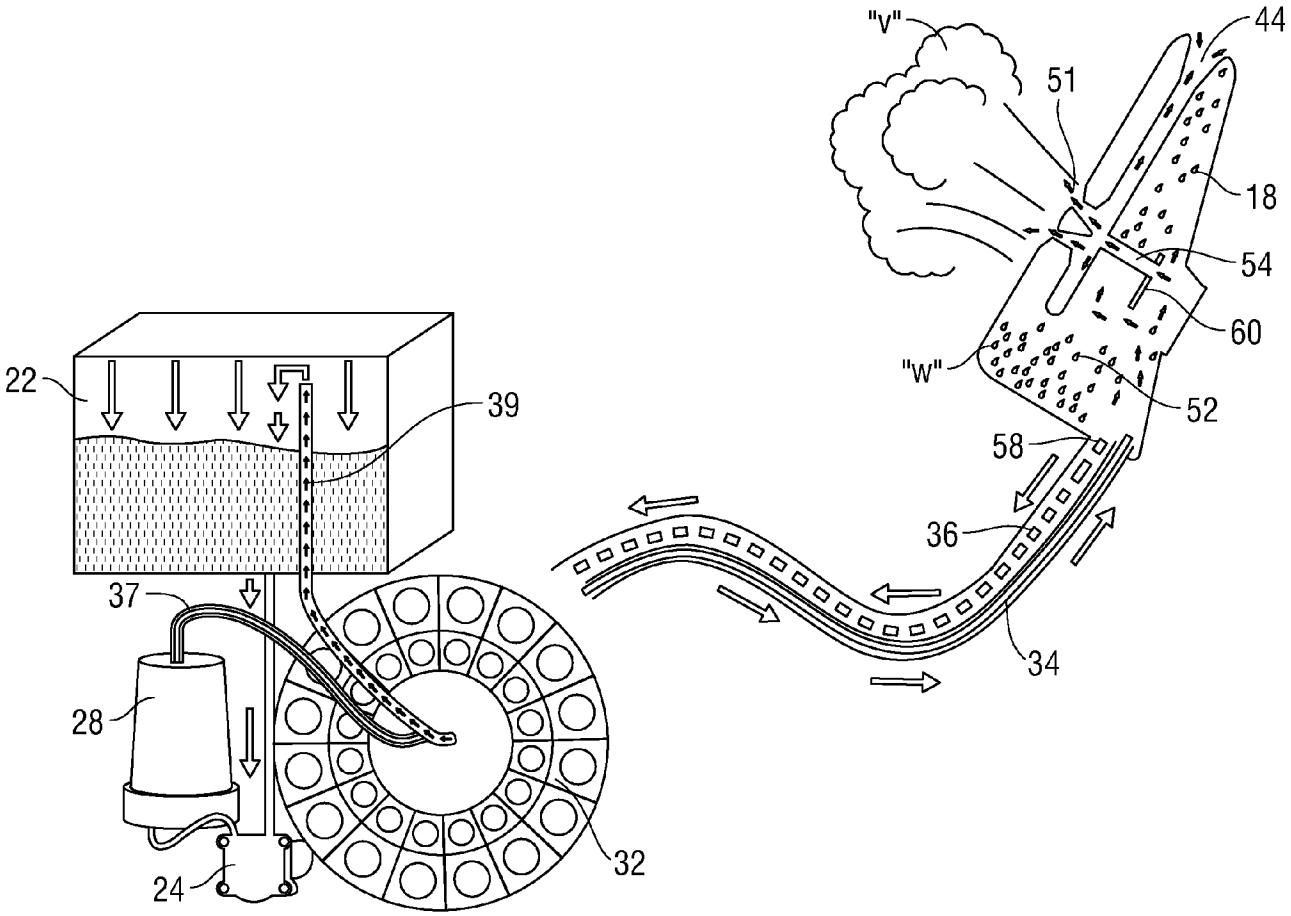
FIG. 24 is a perspective view illustrating operation of the garment treatment system.

FIG. 24 illustrates use of the garment treatment system 10. As shown, when the system 10 is activated, water is pumped from the water tank 22 to the steam generator 28 by the pump 24. Steam is produced at the steam generator 28 and then transferred to the central stationary shaft 80 of the automatic hose reel mechanism 32 via tubing 37. The steam is conveyed through the central stationary shaft 80 as discussed hereinabove and delivered through the steam lumen 36 of the dual lumen hose 16 to the steam nozzle 18. The steam emitted through the steam outlet 54 creates a pressurized environment inside the gap 44. The pressurized steam exits the steam passages 51. Concurrently therewith, the steam will be condensed into water due to heat loss at the steam nozzle 18. Due to the elevated location of the steam outlet 54, the condensed water will not flow through to the outlet 54 but will flow via gravity within the reservoir 52 toward the water outlet 58 of the nozzle 18. The condensed water is drawn under, e.g., a vacuum through the water lumen 36 of the dual lumen hose 16, into the water tank 22 which is sealed and is subjected to a negative pressure environment as a result of operation of the pump 24. Once inside the water tank 22, the water is re-circulated to the steam generator 28 to produce steam for emission from the steam nozzle 18.

The emitted steam through steam outlet 54 and the steam passages 51 will heat the soleplate 46 in a conventional manner to apply heat and iron clothing positioned against the soleplate 46. During operation, the volume of steam emitted through the steam outlet 54 may be controlled by the steam adjustment mechanism 60 (FIGS. 11A-11C) in the manner discussed hereinabove. As one added feature, the surrounding air inside the straightening gap 44 will be drawn into the steam channel due to, e.g., the Bernoulli principle, and then directed through the steam passages 51.

Figure 25:
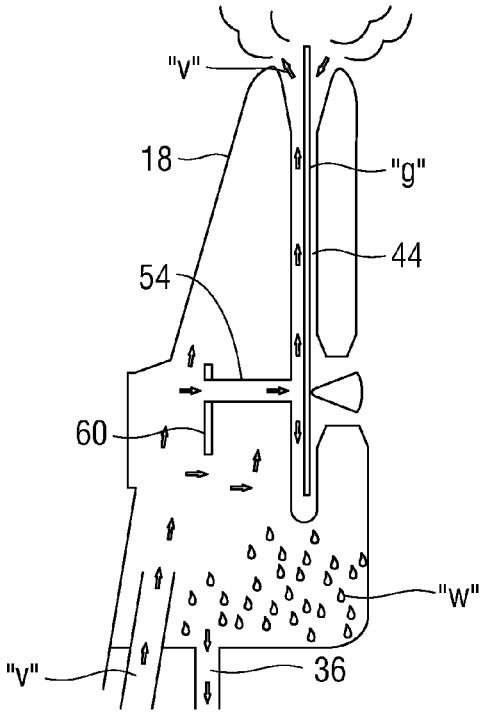
FIG. 25 is a schematic view of the steam nozzle with a garment positioned within the straightener gap of the steam nozzle.

FIG. 25 illustrates the steam nozzle 18 used as a straightener. When there is a garment "g" positioned in to the straightening gap 44, the steam "v" will exit the steam outlet 54 and enter the straightening gap 44. The steam "v" impinges on the garment "g" and may pass through the garment "g" to apply a straightening effect thereto. Potentially, the entire volume of steam "v" exiting the steam outlet 54 is concentrated inside the straightening gap 44 to maximize straightening performance on the garment "g". The condensed water is re-circulated as described hereinabove.

Figure 26:
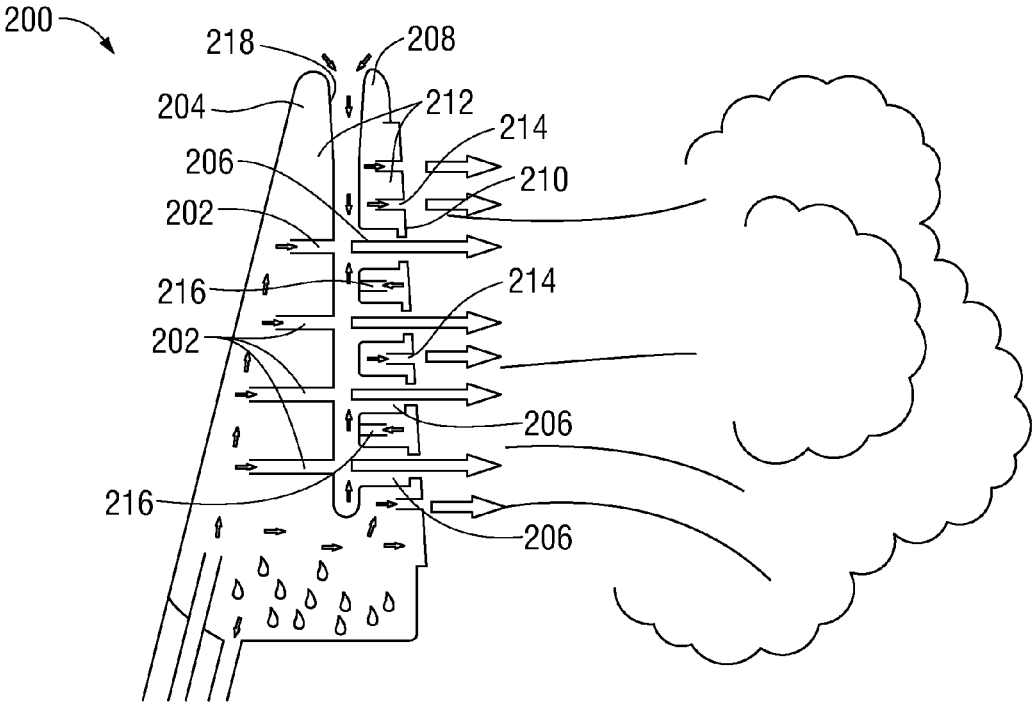
FIG. 26-27 are schematic views of an alternate embodiment of the steam nozzle.
Figure 27:
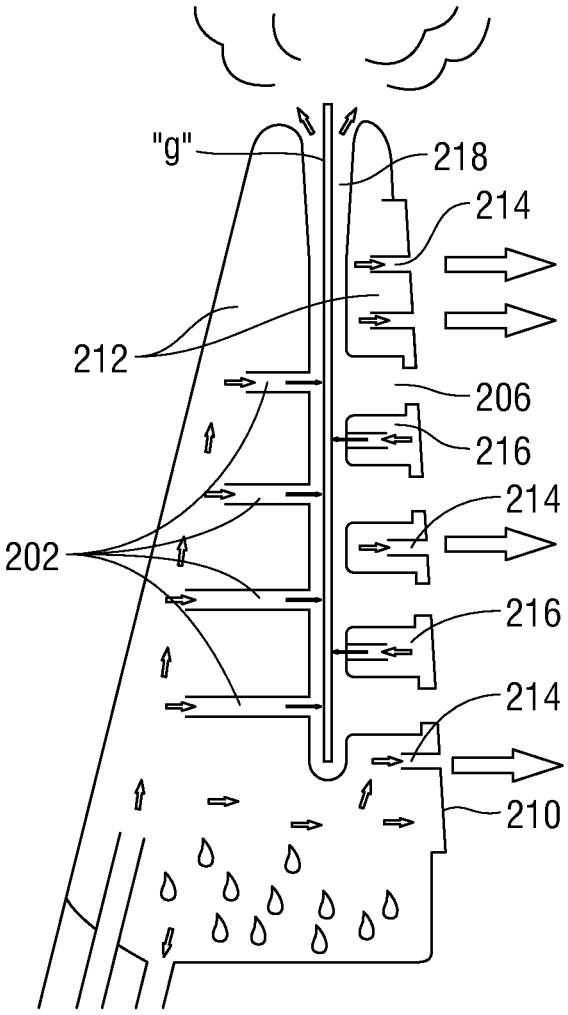

FIGS. 26-27 illustrate an alternate embodiment of the steam nozzle. The steam nozzle 200 embodiment includes a plurality of steam outlets 202 extending through upper housing component 204 and a plurality of steam passages 206 extending through the lower housing component 208 and the sole plate 210. In one embodiment, each steam outlet 202 includes a corresponding aligned steam passage 204. The upper and lower housing components 204, 208 define a chamber 212. The steam nozzle 200 further includes supplemental steam outlets 214 adjacent the sole plate 210, which provide additional steam flow through the sole plate 210 in communication with the chamber 212. The supplemental steam outlets 214 maintain a relatively high temperature of the sole plate 210, and along with the steam passages 206, evenly distribute steam through the sole plate 210. The steam nozzle 210 further includes reverse steam outlets 216 which are in fluid communication with the chamber 212, and direct steam into the straightener gap 218 in an opposite direction to the flow of steam of the steam outlets 202, the steam passages 206 and the steam outlets 214. This further enhances the straightening effect on a garment "g" positioned in the straightener gap 218 (FIG. 27). In particular, both sides of the garment "g" are subjected to steam flow via the steam outlets 202 and the reverse stream outlets 216. Condensed water is re-circulated to the water tank in the aforedescribed manner.

Figure 28:
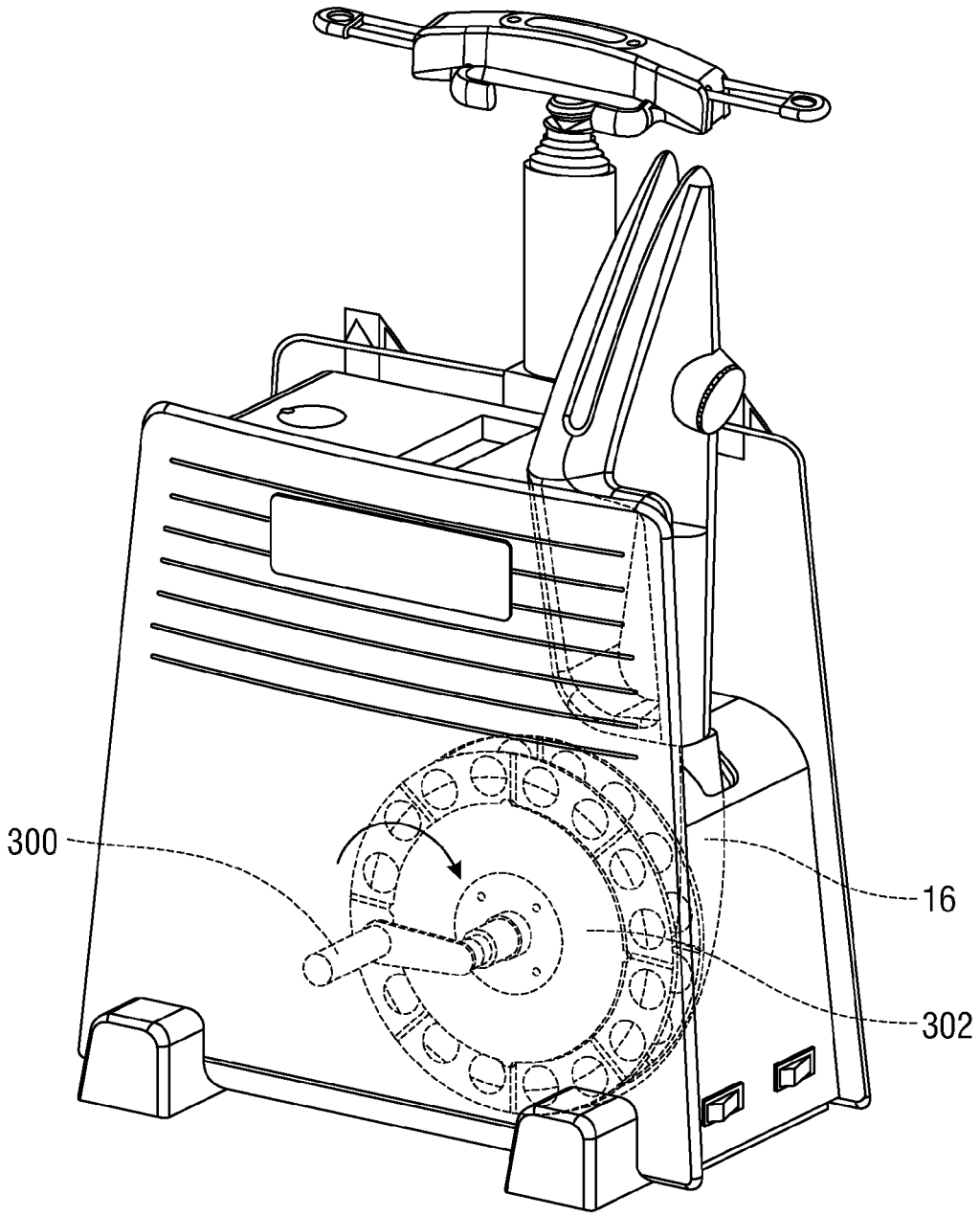
FIG. 28 is a view of an alternate embodiment of the garment treatment system incorporating a manual handle.

FIG. 28 illustrates an alternate embodiment where a hose handle 300 is manually manipulated to wind and unwind the hose reel 302 and the dual lumen hose 16. The manual hose handle 300 replaces the automatic reel mechanism.

Figure 30:
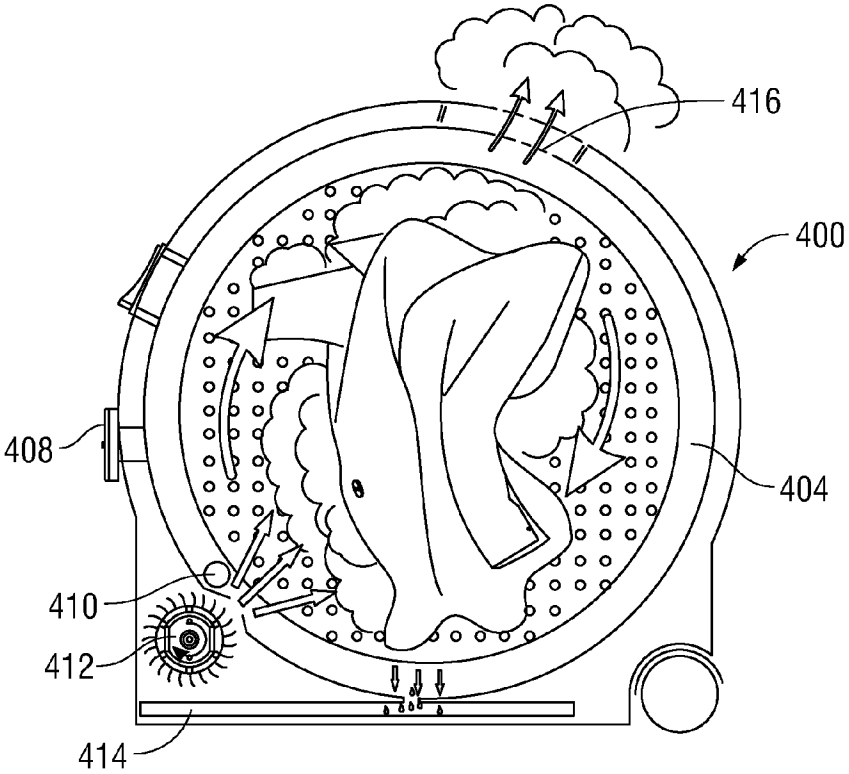
FIGS. 29-30 are perspective and side elevation views illustrating an alternate embodiment of the garment treatment system incorporating a steam refresh compartment.
Figure 29:
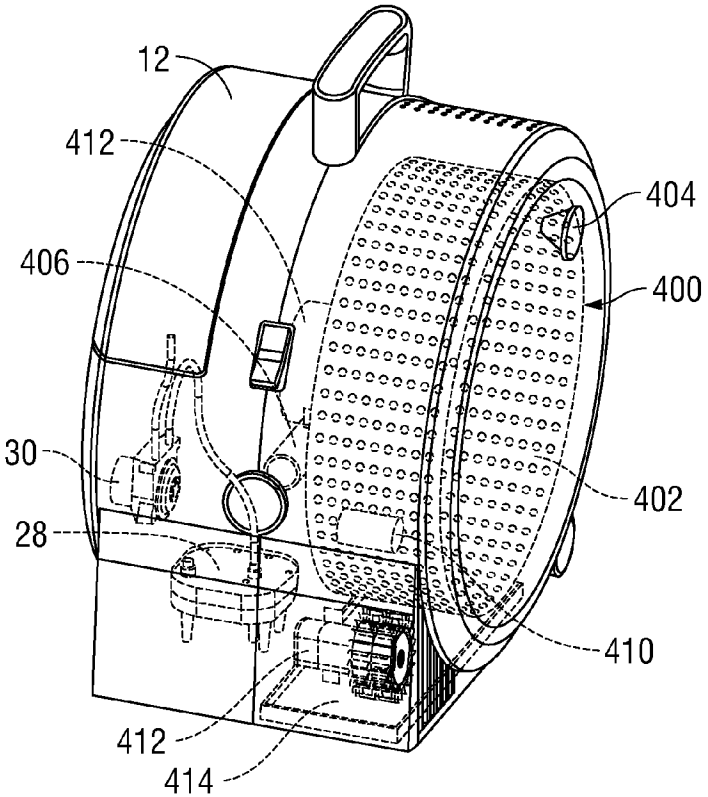

FIGS. 29-30 illustrate an alternate embodiment in which a steam refresh compartment 400 is a component of, or an add on, to the base 12 of the system 10. The steam refresh compartment 400 includes a rotating basket 402 enclosed by a movable door 404. Steam may be directed from the steam generator 28 through a three-way valve 406 and into the interior of the rotating basket 402. A manual control 408 may operate the three-way valve to direct the steam from the steam generator 28 to either the steam nozzle 18 or the steam refresh compartment 400. The steam refresh compartment 400 may also include a UV/ion generator 410 for delivering negative ions within the interior of the basket 402. A motor 412 may be provided to rotate the rotating basket 402. Steam directed into the compartment will refresh the garment to remove any odors, kill bacteria, etc. The UV/ion generator 410 will assist in drying the garment as well as removing odor and help sterilize the garment. A turbine with motor 412 may deliver air into the basket to assist in drying. A drain tray 414 may collect the condensed water from the steam, and, may be in fluid communication with the water tank 22. The refresh compartment 400 may include a vent 416 to vent the interior of the rotating basket 402.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A garment treatment system, which comprises a base;

a water tank mounted to the base and having water contained therein;

a steam generator in fluid communication with the water tank, the steam generator configured to convert the water from the water tank into steam;

a steam nozzle including a steam reservoir and a steam outlet for distributing the steam to a garment;

a hose reel mechanism including:

a central stationary shaft having:

a steam fluid port in fluid communication with the steam generator and an outer steam circumferential lumen in fluid communication with the steam fluid port; and a water port in fluid communication with the water tank and an outer water circumferential lumen in fluid communication with the water port;

a rotating member rotatably mounted about, and relative to, the central stationary shaft and having a steam outlet port in fluid communication with the outer steam circumferential lumen during rotation of the rotating member and a water outlet port in fluid communication with the outer water circumferential lumen during rotation of the rotating member; and a hose mounted to the rotating member, the hose defining a first lumen in fluid communication with the steam outlet port and the steam nozzle for delivering steam to the steam reservoir of the steam nozzle and a second lumen in fluid communication with the steam reservoir of the steam nozzle and the water outlet port for returning condensed water to the water tank.

2. The garment treatment system according to claim 1 including a hose reel mounted to the rotating member and the hose being wound about the hose reel, the hose reel adapted for rotational movement with the rotating member and within the base in a first direction to permit removal of the hose from the hose reel and in a second direction to wind the hose about the hose reel.

3. The garment treatment system according to claim 2 wherein the hose reel includes a releasable lock mechanism for releasably securing the hose at predefined lengths during removal of the hose from the hose reel.

4. The garment treatment system according to claim 3 wherein the releasable lock mechanism includes ratchet teeth associated with the hose reel and a pawl, the ratchet teeth arranged to be selectively engaged by the pawl during movement of the hose reel in the first direction to prevent movement of the hose reel in the second direction.

5. The garment treatment system according to claim 4 including a spring for normally biasing the hose reel toward the second rotational direction.

6. The garment treatment system according to claim 5 wherein the ratchet teeth define a relief area, the pawl entering the relief area upon rotation of the hose reel in the first direction through a predetermined angular sector of rotation whereby the pawl releases the ratchet teeth and permits the hose reel to rotate in the second rotational direction under the bias of the spring.

7. The garment treatment system according to claim 1 wherein the steam nozzle includes an upper and a lower housing component separated by a garment receiving gap, the garment receiving gap dimensioned to receive a portion of a garment whereby steam released from the steam outlet contacts the garment portion of the garment to provide a straightening effect on the garment portion.

8. The garment treatment system according to claim 7 wherein the lower housing component includes a sole plate.

9. The garment treatment system according to claim 8 wherein the sole plate includes at least one steam channel, the at least one steam channel permitting passage of steam.

10. The garment treatment system according to claim 9 including a pair of steam channels extending through the sole plate.

11. The garment treatment system according to claim 10 including a plurality of steam outlets and a plurality of steam channels in the sole plate.

12. The garment treatment system according to claim 7 wherein the steam nozzle includes a steam adjustor to control the volume of steam emitted by the steam outlet.

13. The garment treatment system according to claim 12 wherein the steam adjustor includes a steam adjustor knob and an adjustor plate connected to the adjustor knob, the adjustor plate defining an elongated steam adjustor gap having a varied cross-sectional dimension, the steam adjustor knob movable to selectively position the steam adjustor gap relative to the steam outlet to control the volume of flow of steam through the steam adjustor gap and the steam outlet.

14. The garment treatment system according to claim 1 including a pole extending from the base and a handle coupled to the pole.

15. The garment treatment system according to claim 14 wherein the handle includes a retractable hanger, the retractable hanger including a first hanger segment and a second hanger segment, the first and second hanger segments adapted to move in opposing directions within the handle between a stored and an operable condition.

16. The garment treatment system according to claim 15 wherein the handle includes a nozzle holder segment for supporting the steam nozzle.

17. The garment treatment system according to claim 1 including at least one seal ring positioned between the rotating member and the central stationary shaft.

18. The garment treatment system according to claim 17 including first second and third seal rings positioned between the rotating member and the central stationary shaft, the first and second seal rings fluidly sealing and isolating the outer steam circumferential lumen of the central stationary member and the second and third seal rings fluidly sealing and isolating the outer water circumferential lumen of the central stationary shaft.

* * * * *